US008890755B2

(12) United States Patent
He

(10) Patent No.: US 8,890,755 B2
(45) Date of Patent: Nov. 18, 2014

(54) ANTENNA HOLDING DEVICE

(75) Inventor: Xiao-Lian He, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 245 days.

(21) Appl. No.: 13/337,129

(22) Filed: Dec. 25, 2011

(65) Prior Publication Data

US 2013/0093644 A1 Apr. 18, 2013

(30) Foreign Application Priority Data

Oct. 14, 2011 (CN) ..... 2011 1 0311591

(51) Int. Cl.
*H01Q 1/12* (2006.01)
*H01Q 3/00* (2006.01)

(52) U.S. Cl.
CPC ..... *H01Q 1/1207* (2013.01)
USPC ..... 343/703; 343/760; 343/894

(58) Field of Classification Search
None
See application file for complete search history.

(56) References Cited

U.S. PATENT DOCUMENTS

| | | | | |
|---|---|---|---|---|
| 6,556,023 | B2 * | 4/2003 | Okazaki | 343/763 |
| 6,563,301 | B2 * | 5/2003 | Gventer | 324/750.27 |
| 2010/0134364 | A1 * | 6/2010 | Okazaki | 343/703 |
| 2010/0215428 | A1 * | 8/2010 | Trice | 403/359.5 |

* cited by examiner

*Primary Examiner* — Michael C Wimer
*Assistant Examiner* — Michael Bouizza
(74) *Attorney, Agent, or Firm* — Novak Druce Connolly Bove + Quigg LLP

(57) ABSTRACT

An antenna holding device for holding test antennas includes a base, a holding pole, a sleeve unit, and a support pole. The holding pole is perpendicularly mounted on the base. The sleeve unit includes a movable sleeve, and the movable sleeve slidably and rotatably mounted on the holding pole. The support pole is mounted on the sleeve unit for mounting the test antennas.

12 Claims, 2 Drawing Sheets

ANTENNA HOLDING DEVICE

BACKGROUND

1. Technical Field

The present disclosure relates to antenna holding devices, and particularly to an antenna holding device for electromagnetic measurements.

2. Description of Related Art

In electromagnetic measurements, such as electromagnetic interference (EMI) and site voltage standing-wave ratio (SVSWR) measurements, various kinds of test antennas may need to be respectively mounted on predetermined measuring locations to transmit and/or receive test signals. Furthermore, many relevant parameters (e.g., positions, heights, and polarities) of the test antennas often need to be adjusted. Frequently mounting the test antennas to and removing the test antennas from the measuring locations and making the adjustments for the parameters may damage the test antennas and are also labor intensive.

Therefore, there is room for improvement within the art.

BRIEF DESCRIPTION OF THE DRAWINGS

Many aspects of the present disclosure can be better understood with reference to the following drawings. The components in the various drawings are not necessarily drawn to scale, the emphasis instead being placed upon clearly illustrating the principles of the present disclosure. Moreover, in the drawings, like reference numerals designate corresponding parts throughout the figures.

DETAILED DESCRIPTION

Figure 1:
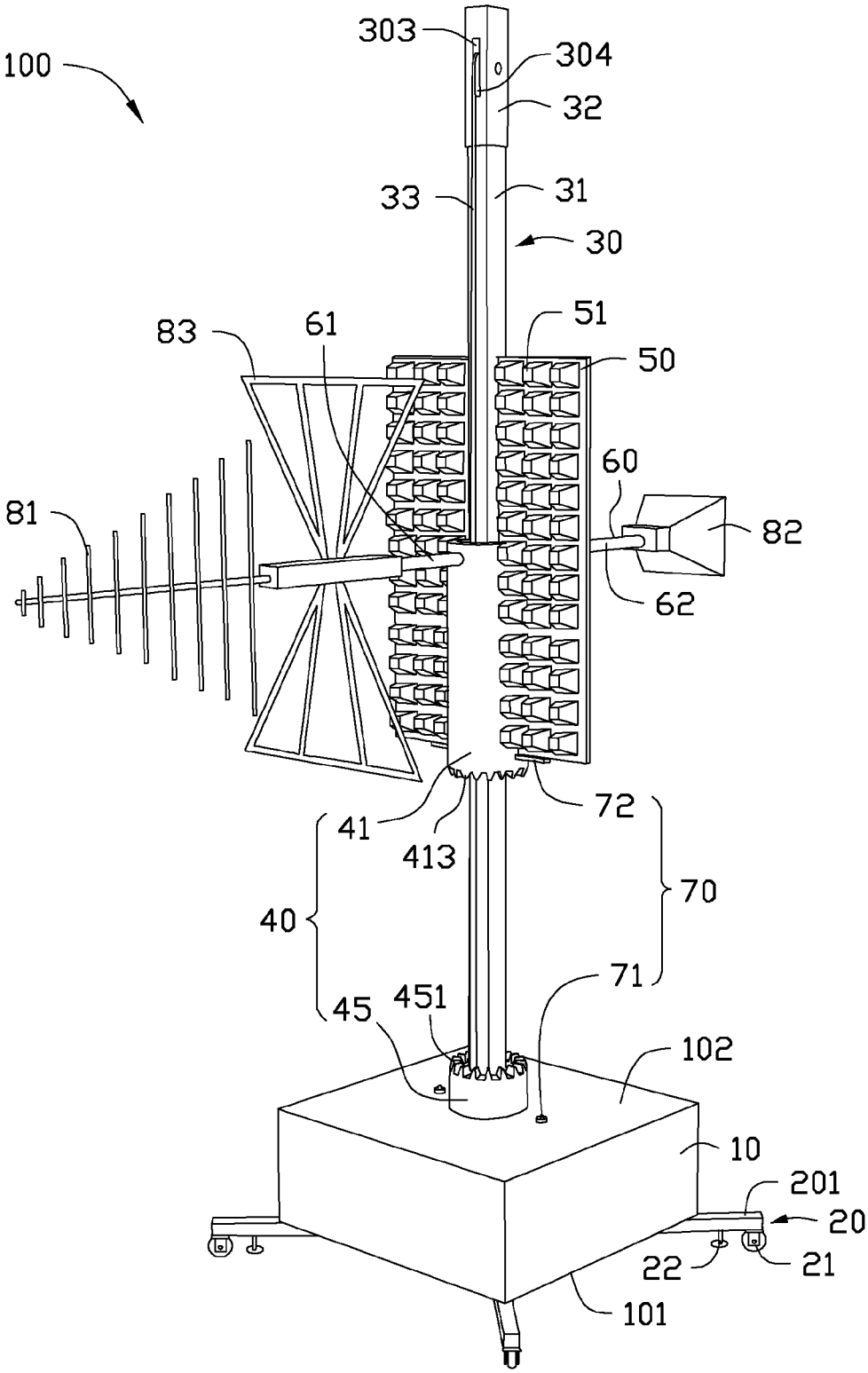
FIG. 1 is a schematic view of an antenna holding device, according to an exemplary embodiment.
Figure 2:
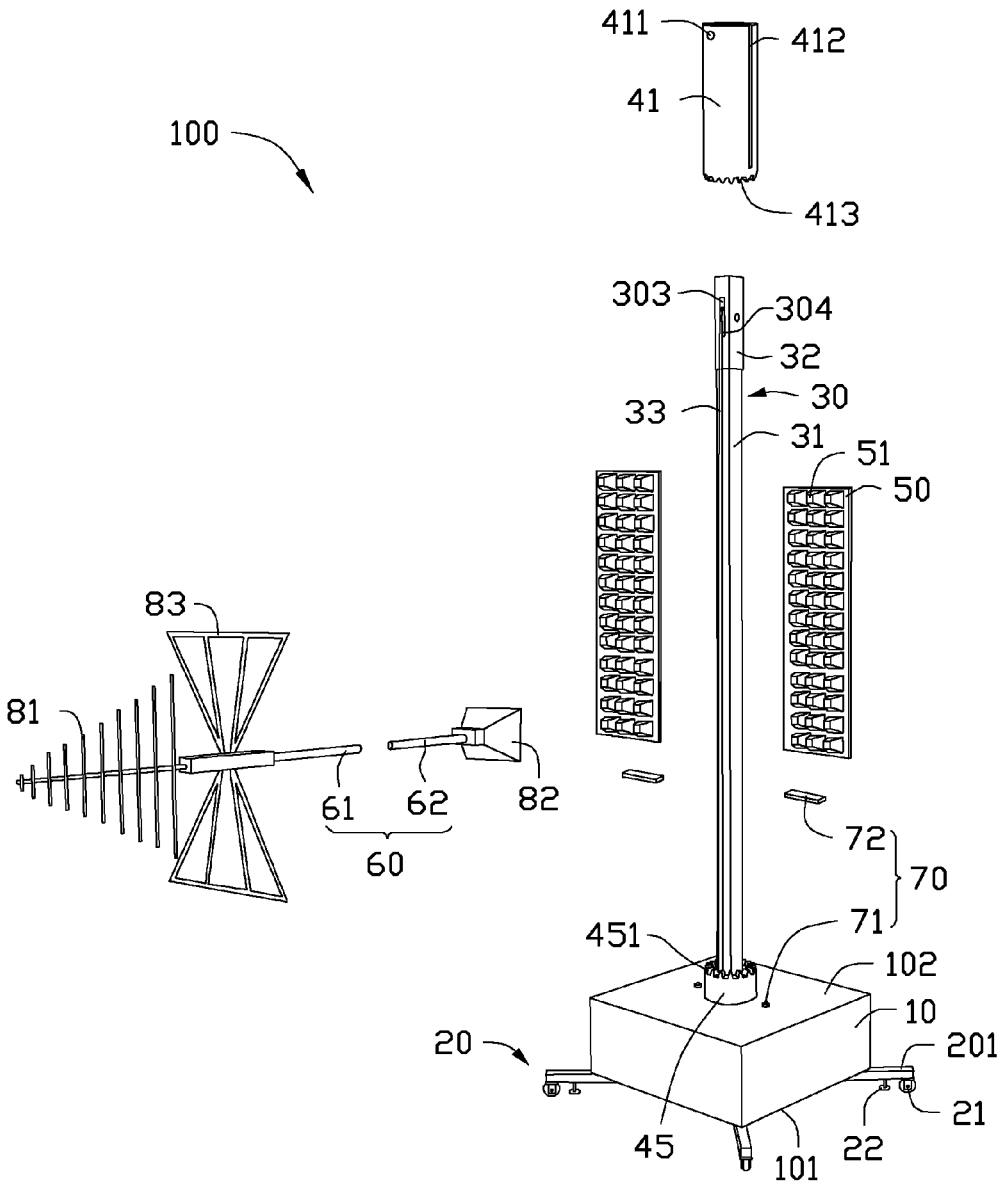
FIG. 2 is an exploded view of the antenna holding device shown in FIG. 1.

FIG. 1 and FIG. 2 show an antenna holding device 100, according to an exemplary embodiment. The antenna holding device 100 can be used to simultaneously hold various test antennas for electromagnetic measurements, such as electromagnetic interference (EMI) and site voltage standing-wave ratio (SVSWR) measurements. In this embodiment, a first test antenna 81, a second test antenna 82, and a third test antenna 83, which are different kinds of antennas, can be together held on the antenna holding device 100.

The antenna holding device 100 includes a base 10, a holder 20, an adjusting pole 30, a sleeve unit 40, a pair of isolation boards 50, a supporting pole 60, and a detection unit 70. The base 10 is substantially a cuboid-shaped casing, and includes a bottom surface 101 and a top surface 102. The holder 20 is substantially cross-shaped and mounted under the base 10. The holder 20 includes four beams 201 converged together, and four conveying wheels 21 and four support feet 22 which are all mounted on undersides of the beams 201. In this embodiment, each of the beams 201 has one conveying wheel 21 and one support foot 22 correspondingly mounted on the underside of the beam 201. The four conveying wheels 21 are respectively rotatably mounted on four distal ends of the beams 201, and thus the holder 20 and the base 10 can be horizontally moved due to rotation of the conveying wheels 21. Each of the support feet 22 is positioned adjacent to a corresponding one of the conveying wheels 21 for retaining the holder 20 on predetermined locations. The support feet 22 are preferably able to extend from and retract into the holder 20. In this way, the support feet 22 can retract to allow the conveying wheels 21 to make contact with a ground and roll on the ground when the holder 20 needs to be moved, and be extended to hold the holder 20 when the holder 20 needs to be stationary.

The adjusting pole 30 includes a pole body 31, a rotation head 32, and a transmission belt 33. One end of the pole body 31 is perpendicularly fixed on a center of the top surface 102. The rotation head 32 is mounted on an opposite end of the pole body 31 and can rotate around an axis of the pole body 31. A longitudinal (i.e., extending along the pole body 31) transmission hole 303 is defined in the rotation head 32, and an adjusting wheel 304 is longitudinally received and rotatably mounted in the transmission hole 303. The transmission belt 33 is coiled on the adjusting wheel 304 and is pulled to extend longitudinally along the pole body 31 by typical methods, such as a motor (not shown). A rotation of the adjusting wheel 304 can drive the transmission belt 33 to move along the pole body 31.

The sleeve unit 40 includes a movable sleeve 41 and a stationary sleeve 45, which are both hollow cylinders and respectively coaxially surround parts of the pole body 31. Diameters of the movable sleeve 41 and the stationary sleeve 45 are the same. The stationary sleeve 45 surrounds the bottom end of the pole body 31 and is fixed on the top surface 102 of the base 10. A part of the transmission belt 33 is attached in the movable sleeve 41. In this way, movements of the transmission belt 33 along the pole body 30 can drive the movable sleeve 41 to slide along the pole body 31 via the transmission belt 33. In addition, rotations of the rotation head 32 can drive the movable sleeve 41 to rotate around the axis of the pole body 31 via the adjusting wheel 304 and the transmission belt 33. The movable sleeve 41 defines two opposite and collinear assembling holes 411, and two opposite and parallel assembling grooves 412. The assembling holes 411 are arranged to alternate with the assembling grooves 412. The two assembling holes 411 are adjacent to a top end of the movable sleeve 41 (i.e., an end of the movable sleeve 41 positioned opposite to the stationary sleeve 45). The two assembling grooves 412 extend parallel to the pole body 31. Furthermore, engaging teeth 413, 451 are respectively formed on both a bottom end of the movable sleeve 41 and a top end of the stationary sleeve 45 (i.e., ends of the movable sleeve 41 and the stationary sleeve 45 positioned towards each other). Such that the movable sleeve 41 can be stably placed on the stationary sleeve 45 by the engaging teeth 413 of the movable sleeve 41 and the engaging teeth 451 of the stationary sleeve 45 engaging with each other.

Each of the isolation boards 50 is substantially a rectangular planar board. Electromagnetic absorptive layers 51 are formed on both two opposite surfaces of each of the isolation boards 50. One side of each isolation board 50 is fixed in one of the assembling grooves 412, correspondingly, thereby assembling the pair of isolation boards 50 on the movable sleeve 41.

The supporting pole 60 includes a first pole section 61 and a second pole section 62. Each of the first pole section 61 and the second pole section 62 has one end fixed in one of the assembling holes 411, correspondingly, and thus the first pole section 61 and the second pole section 62 are collinearly mounted on the movable sleeve 41.

The detection unit 70 includes a pair of infrared emitters 71 and a pair of infrared sensors 72. The two infrared emitters 71 are mounted on the top surface 102 of the base 10, and the two infrared sensors 72 are respectively mounted on an underside surface of the isolation boards 50. Rotations of the movable sleeve 41 can respectively align the two infrared sensors 72 with the two infrared emitters 71.

In use, test antennas, such as the first test antenna 81, the second test antenna 82, and the third antenna 83, are mounted on the supporting pole 60, and electrically connected to a common processor (not shown), such as a personal computer (PC) or a single chip computer. In this embodiment, the first test antenna 81 is a fishbone antenna, the second test antenna 82 is a horn antenna, and the third test antenna 83 is a bow-tie antenna. According to known characteristics of these kinds of antennas, signal transmission and reception of fishbone antennas and bow-tie antennas generally do not interfere with each other. Therefore, the first test antenna 81 and the third test antenna 83 are mounted on the first pole section 61, and the second test antenna 82 is mounted on the second pole section 62. In this way, the first test antenna 81 and the third test antenna 83 are electromagnetically isolated from the second test antenna 82 by the electromagnetic absorptive layers 51 of the isolation boards 50.

The infrared sensors 72 are also electrically connected to the processor. The rotation head 32 is rotated and drives the movable sleeve 40, the isolation boards 50, and the infrared sensors 72 to rotate around the axis of the pole body 31, until the two infrared sensors 72 are respectively aligned with the two infrared emitters 71. The infrared sensors 72 then respectively receive infrared light emitted from the two infrared emitters 71 and generate corresponding detection signals. In response to receiving the detection signals from the infrared sensors 72, the processor determines that the two infrared sensors 72 are respectively aligned with the two infrared emitters 71. Thus, the movable sleeve 41 is pushed to slide downwards along the pole body 31, until the engaging teeth 413 of the movable sleeve 41 and the engaging teeth 451 of the stationary sleeve 45 engage with each other to stably hold the movable sleeve 41 on the stationary sleeve 45.

The antenna holding device 100 with the mounted test antennas 81, 82, 83 is then placed on a selected electromagnetic measuring location, and the whole antenna holding device 100 is rotated to position a selected one of the test antennas 81, 82, 83 towards a predetermined measuring direction for transmitting and/or receiving test signals. The adjusting wheel 304 is rotated and drives the movable sleeve 41 to slide along the pole body 31 via the transmission belt 33, thereby adjusting the selected test antenna 81/82/83 to a predetermined height. Thus, the selected test antenna 81/82/83 can be used in electromagnetic measurements. During the electromagnetic measurements, the electromagnetic absorptive layers 51 of the isolation boards 50 can prevent the second test antenna 82 from interfering with signal transmission and reception of the first test antenna 81 and the third test antenna 83, and vice versa.

The antenna holding device 100 can enable the electromagnetic measurement to easily use different test antennas. If two or more different test antennas do not interfere with signal transmission and reception of each other, such as the first test antenna 81 and the third test antenna 83, the two test antennas can be mounted at a same pole section 61/62 and can be simultaneously used according to the aforementioned method.

If two different test antennas may interfere with signal transmission and reception of each other, such as the first test antenna 81 and the second test antenna 82, the two test antenna are respectively mounted on the first pole section 61 and the second pole section 62. When the two test antennas need to be used in a same electromagnetic measurement, one of the two test antennas (e.g., the first test antenna 81) is first used according to the aforementioned method. Thus, the rotation head 32 is rotated and drives the movable sleeve 40, the isolation boards 50, and the infrared sensors 72 to rotate around the axis of the pole body 31. When the infrared sensors 72 are rotated to deviate from the infrared emitters 71, the infrared sensors 72 do not receive the infrared light from the infrared emitters 71, and thus do not generate the detection signals. In response to not receiving the detection signals from the infrared sensors 72, the processor determines that none of the test antennas are positioned towards the measuring direction.

Until the movable sleeve 40 rotates 180 degrees and the other test antenna (e.g., the second test antenna 82) is aligned with the measuring direction, the two infrared sensors 72 are respectively aligned with the two infrared emitters 71 again. Thus, the infrared sensors 72 receive the infrared light from the infrared emitters 71 and generate the detection signals again. In response to receiving the detection signals from the infrared sensors 72 again, the processor determines that other test antenna is aligned with the measuring direction, and thus the other test antenna can be used, with the same height and measuring direction as that of the previous test antenna. In use of both the two test antennas, the electromagnetic absorptive layers 51 of the isolation boards 50 can prevent the two test antennas from interfering with signal transmission and reception of each other.

In the present disclosure, polarities of test antennas mounted on the antenna holding device 100, such as the test antennas 81, 82, 83, can be changed by means of rotating the test antennas around an axis of the first pole section 61 and the second pole section 62. It is readily appreciated that mounting locations of the infrared emitters 71 can be exchanged with mounting locations of the infrared sensors 72.

The antenna holding device 100 can simultaneously hold a plurality of test antennas for being simultaneously or respectively used. Relevant parameters, such as positions, heights, and polarities of the test antennas, can be easily adjusted. Furthermore, when a currently used one of the test antennas mounted on the antenna holding device 100 is changed from one to another, the previous test antenna does not need to be removed from the antenna holding device 100, and the next test antenna can easily obtain the same height and measuring direction as that of the previous test antenna. Compared with common methods, the present disclosure can be operated more easily.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. An antenna holding device for holding two opposite test antennas, comprising:

a base;

an adjusting pole perpendicularly mounted on the base;

a sleeve unit including a movable sleeve, the movable sleeve slidably and rotatably mounted on the adjusting pole;

a support pole mounted on the sleeve unit for mounting the test antennas; and a detection unit comprising two infrared emitters and two infrared sensors, the two infrared emitters mounted on the base, and the two infrared sensors rotate around an axis of the adjusting pole; the two infrared sensors respectively receiving infrared light from the infrared emitters when the two infrared sensors are respectively aligned with the two infrared emitters;

wherein the two infrared sensors rotate 180 degrees and are respectively aligned with the two infrared emitters to test one of the two opposite test antennas.

2. The antenna holding device as claimed in claim 1, wherein the adjusting pole includes a pole body perpendicularly mounted on the base, the movable sleeve coaxially surrounds a part of the pole body, and is slidable along the pole body and rotatable about an axis of the pole body.

3. The antenna holding device as claimed in claim 2, wherein the adjusting pole further includes an adjusting wheel and a transmission belt; the adjusting wheel rotatably mounted on the pole body, the transmission belt coiled on the adjusting wheel and extending along the pole body, a part of the transmission belt attached on the movable sleeve, and rotations of the adjusting wheel driving the movable sleeve to slide along the pole body via the transmission belt.

4. The antenna holding device as claimed in claim 3, wherein the adjusting pole further includes a rotation head; the rotation head mounted on end of the pole body and being rotatable about an axis of the pole body, the adjusting wheel rotatably mounted on the rotation head, and rotations of the rotation head driving the movable sleeve to rotate around the axis of the pole body via the adjusting wheel and the transmission belt.

5. The antenna holding device as claimed in claim 1, wherein the sleeve unit further includes a stationary sleeve, the stationary sleeve surrounding a part of the pole body and fixed on the base; engaging teeth respectively formed on ends of the movable sleeve and the stationary sleeve which are positioned towards each other, such that the movable sleeve is stably placed on the stationary sleeve by the engaging teeth of the movable sleeve and the stationary sleeve engaging with each other.

6. The antenna holding device as claimed in claim 1, wherein the antenna holding device is configured for simultaneously holding a plurality of test antennas in different kinds, and the support pole includes two pole sections configured for supporting different kinds of test antennas, respectively.

7. The antenna holding device as claimed in claim 6, further comprising two isolation boards, wherein electromagnetic absorptive layers are formed on both two opposite surfaces of each isolation board, and the two isolation boards are mounted on the movable sleeve to electromagnetically isolate the test antennas respectively mounted on the two pole sections from each other.

8. The antenna holding device as claimed in claim 7, wherein the detection unit is configured for detecting positions of the test antennas mounted on the support pole relative to the base unit.

9. The antenna holding device as claimed in claim 8, wherein the two infrared sensors respectively mounted on the isolation boards.

10. The antenna holding device as claimed in claim 7, wherein the movable sleeve defines two opposite and parallel assembling grooves, the two isolation boards are respectively fixed in the two assembling grooves.

11. The antenna holding device as claimed in claim 10, wherein the movable sleeve defines two opposite and collinear assembling holes, the two assembling holes are arranged to alternate with the assembling grooves.

12. The antenna holding device as claimed in claim 10, wherein each of two pole sections has one end fixed in one of the assembling holes, and two pole sections are collinearly mounted on the movable sleeve.

* * * * *